US007995025B2

(12) United States Patent
Teranishi

(10) Patent No.: US 7,995,025 B2
(45) Date of Patent: Aug. 9, 2011

(54) LIQUID CRYSTAL DISPLAY DEVICE

(75) Inventor: Kentaro Teranishi, Kanazawa (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 816 days.

(21) Appl. No.: 11/683,617

(22) Filed: Mar. 8, 2007

(65) Prior Publication Data

US 2007/0211009 A1 Sep. 13, 2007

(30) Foreign Application Priority Data

Mar. 10, 2006 (JP) ..... 2006-065302

(51) Int. Cl.
*G09G 3/36* (2006.01)

(52) U.S. Cl. ..... 345/100; 345/87; 345/99

(58) Field of Classification Search ..... 345/99, 345/100, 87
See application file for complete search history.

(56) References Cited

U.S. PATENT DOCUMENTS

| | | | | |
|---|---|---|---|---|
| 6,304,242 | B1 * | 10/2001 | Onda | 345/99 |
| 6,396,469 | B1 * | 5/2002 | Miwa et al. | 345/87 |
| 6,445,372 | B1 * | 9/2002 | Asai | 345/99 |
| 6,473,077 | B1 * | 10/2002 | Takenaka et al. | 345/209 |
| 7,161,574 | B2 * | 1/2007 | Kimura et al. | 345/96 |
| 2003/0090449 | A1 * | 5/2003 | Arimoto et al. | 345/87 |
| 2003/0169247 | A1 * | 9/2003 | Kawabe et al. | 345/204 |
| 2005/0253794 | A1 * | 11/2005 | Lee et al. | 345/87 |

FOREIGN PATENT DOCUMENTS

| | | |
|---|---|---|
| JP | 2000-122596 | 4/2000 |
| JP | 2001-60076 | 3/2001 |
| JP | 2002-202491 | 7/2002 |
| JP | 2002-328654 | 11/2002 |
| JP | 2004-61552 | 2/2004 |
| JP | 2004-226522 | 8/2004 |
| JP | 2004-264481 | 9/2004 |
| JP | 2005-242313 | 9/2005 |
| WO | WO 2007/015347 A1 | 2/2007 |

OTHER PUBLICATIONS

Japanese Office Action issued on Feb. 1, 2011 in the corresponding Japanese Patent Application No. 2006-065302 (with English Translation).

* cited by examiner

*Primary Examiner* — Amare Mengistu
*Assistant Examiner* — Premal Patel
(74) *Attorney, Agent, or Firm* — Oblon, Spivak, McClelland, Maier & Neustadt, L.L.P.

(57) ABSTRACT

A liquid crystal display device includes liquid crystal pixels arrayed substantially in a matrix, a vertical driving circuit that selects the rows of pixels for video signal writing and for non-video signal writing, a horizontal driving circuit that writes a video signal in the pixels of a row selected for the video signal writing and a non-video signal in the pixels of a row selected for the non-video signal writing, and a control circuit that controls operation timings of the horizontal driving circuit and vertical driving circuit. In particular, the vertical driving circuit is configured to set a selection pattern for disabling an overlap between a selection period of selecting the pixels of each row for the video signal writing and a selection period of selecting the pixels of another row for the non-video signal writing, based on enable signals from the control circuit.

3 Claims, 5 Drawing Sheets

LIQUID CRYSTAL DISPLAY DEVICE

CROSS-REFERENCE TO RELATED APPLICATIONS

This application is based upon and claims the benefit of priority from prior Japanese Patent Application No. 2006-065302, filed Mar. 10, 2006, the entire contents of which are incorporated herein by reference.

BACKGROUND OF THE INVENTION

1. Field of the Invention

The present invention relates to a liquid crystal display device that makes a liquid crystal display panel of, for example, an optically compensated bend (OCB) mode to periodically perform video signal display and non-video signal display.

2. Description of the Related Art

Flat-panel display devices realized by liquid crystal display devices are widely used to display images in computers, car navigation systems, TV receivers and similar equipment. A typical liquid crystal display device utilizes a liquid crystal display panel that includes a matrix array of liquid crystal pixels, and a display panel control circuit that controls the display panel. The liquid crystal display panel has a structure in which a liquid crystal layer is held between an array substrate and a counter-substrate.

The array substrate includes a plurality of pixel electrodes arrayed substantially in a matrix, a plurality of gate lines arranged along the rows of pixel electrodes, respectively, a plurality of source lines arranged along the columns of pixel electrodes, and a plurality of switching elements arranged near intersections between the gate lines and the source lines. Each of the switching elements is composed of, e.g., a thin-film transistor (TFT). The switching element is turned on when one associated gate line is driven, thereby applying a potential of one associated source line to one associated pixel electrode. The counter-substrate includes a common electrode which is opposed to the pixel electrodes disposed on the array substrate. A pair of one pixel electrode and the common electrode, together with a pixel region that is a part of the liquid crystal layer held between these electrodes constitute a pixel and control the alignment of liquid crystal molecules in the pixel region by an electric field created according to a liquid crystal drive voltage, which is a difference in potential between the pixel electrode and common electrode. The display panel control circuit includes a gate driver that drives the gate lines as a vertical driving circuit, a source driver that drives the source lines as a horizontal driving circuit, and a timing controller that controls the operation timings of the gate driver and source driver on the basis of image data and sync signals supplied externally.

In liquid crystal display devices for TV receivers, that principally display moving images, the introduction of a liquid crystal display panel of an OCB mode in which liquid crystal molecules exhibit good responsivity (see Jpn. Pat. Appln. KOKAI Publication No. 2002-202491), has been studied. Before supply of power, liquid crystal molecules are aligned in a splay alignment in which most of the molecules are laid down by alignment films that are provided on the pixel electrode and the common electrode and are rubbed in mutually parallel directions. In this liquid crystal display panel, a display operation is performed after the splay alignment is transitioned to a bend alignment in an initialization process by a relatively intense electric field that is applied upon supply of power.

The reason why the liquid crystal molecules are aligned in the splay alignment before supply of power is that the splay alignment is more stable than the bend alignment in terms of energy in a voltage-non-applied state of a liquid crystal drive voltage. Even if the liquid crystal molecules once transition to the bend alignment, reverse transition from the bend alignment to the splay alignment tends to occur if a voltage-non-applied state, or a voltage-applied state of a voltage not greater than a level at which energy of the splay alignment is balanced with energy of the bend alignment, continues for a long time. In the splay alignment, abnormality in display may occur since the viewing angle characteristics of the splay alignment are sharply different from those of the bend alignment.

In the prior art, in order to prevent the reverse transition from the bend alignment to the splay alignment, such a driving method is adopted that a high voltage is applied to the OCB liquid crystal pixel, for example, in a part of a frame period within which a single-frame image is displayed. In a normally-white liquid crystal display panel, this voltage corresponds to a black-display voltage, so this driving method is called "black insertion driving."

In a conventional black insertion driving method, the gate liens Y1 to Ym shown in FIG. 6 are scanned two times for black insertion writing and video signal writing in two vertical scanning periods by the gate driver. The gate driver includes a shift register that receives a vertical start pulse STV supplied every vertical scanning period, and shifts the vertical start pulse STV in sync with a vertical clock signal CKV. The gate driver sequentially selects and drives the gate lines Y1 to Ym based on the shifted position of the vertical start pulse. The source lines X1 to Xn are driven in parallel by the source driver while each of the gate lines Y1 to Ym is kept driven. The source driver includes a shift register that receives a horizontal start pulse STH supplied every horizontal scanning period, and shifts the horizontal start pulse STH in sync with a horizontal clock signal CKH. To the source driver, items of pixel data (video signal S or black display signal B) for one row (a horizontal line) are supplied in series during the horizontal scanning period. The source driver captures the pixel data items based on the shifted position of the horizontal start pulse STH, converts them into pixel voltages, and outputs the pixel voltages in parallel toward the source lines X1 to Xn, in response to a latch output pulse LT.

However, in the black insertion driving method, the pixels from the first row to the last row perform video signal display with pixel voltages which are sequentially written and held for one vertical scanning period, and perform black insertion display (non-video signal display) with pixel voltages which are sequentially written and held for one vertical scanning period. The video signal S falls within a range from the black display level of the minimum gradation and the white display level of the maximum gradation. If the white display level is maintained for all the pixels, the following display is repeated. That is, the black display area is increased from the upper end of the display panel to the lower end thereof upon the initiation of black insertion write scanning, and then, the white display area is increased from the upper end of the display panel to the lower end thereof upon the initiation of video signal write scanning. Thus, the viewer of the display panel recognizes the variation in luminance occurring on the panel as flicker.

BRIEF SUMMARY OF THE INVENTION

An object of the present invention is to provide a liquid crystal display device that can reduce flicker caused by a periodical operation of the video signal display and non-video signal display.

According to an aspect of the present invention, there is provided a liquid crystal display device which comprises: a plurality of liquid crystal pixels arrayed substantially in a matrix; a vertical driving circuit that selects the rows of liquid crystal pixels for video signal writing and for non-video signal writing; a horizontal driving circuit that writes a video signal in the liquid crystal pixels of a row selected for the video signal writing and a non-video signal in the liquid crystal pixels of a row selected for the non-video signal writing; and a control circuit that controls operation timings of the horizontal driving circuit and vertical driving circuit to perform the video signal writing for the liquid crystal pixels in units of one row in one vertical scanning period and to perform the non-video signal writing for the liquid crystal pixels in units of at least one row after the first video signal writing, with a delay of a time shorter than the vertical scanning period, wherein the vertical driving circuit is configured to set a selection pattern for disabling an overlap between a selection period of selecting the liquid crystal pixels of each row for the video signal writing and a selection period of selecting the liquid crystal pixels of another row for the non-video signal writing, based on a control signal from the control circuit.

In the liquid crystal display device, a selection period of selecting the liquid crystal pixels of each row for the video signal writing does not overlap a selection period of selecting the liquid crystal pixels of another row for the non-video signal writing. Further, the non-video signal display area that occupies the entire display area can be set to a desired ratio by adjusting the time from the first video signal writing to the non-video signal writing, and thus the average luminance can be stabilized. In other words, the non-video signal display area does not change along with time, and therefore flicker that is caused by a periodical operation of the video signal display and non-video signal display can be suppressed.

Additional objects and advantages of the invention will be set forth in the description which follows, and in part will be obvious from the description, or may be leaned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A liquid crystal display device according to an embodiment of the present invention will now be described with reference to accompanying drawings.

Figure 1:
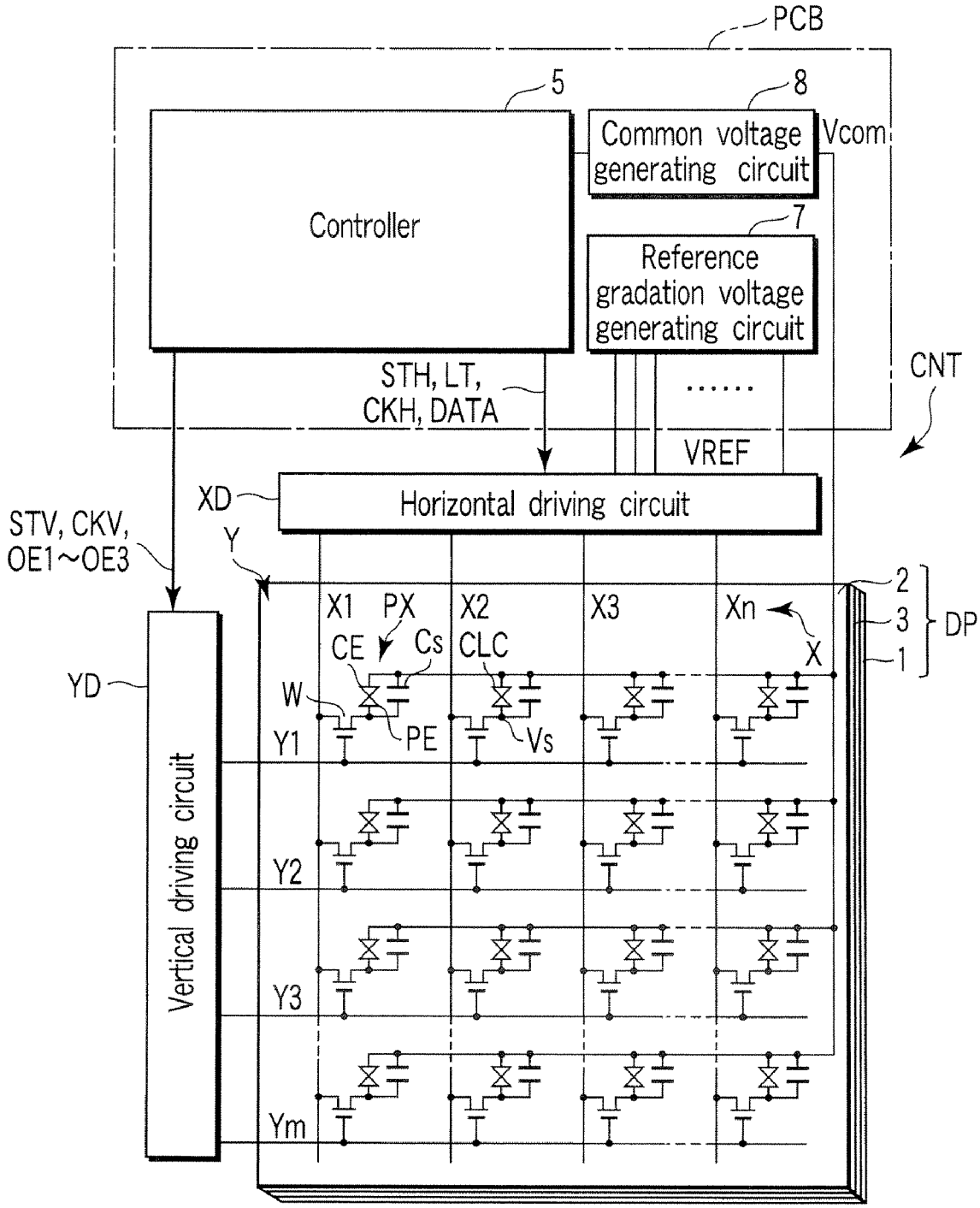
FIG. 1 is a diagram schematically showing the circuit configuration of a liquid crystal display device according to an embodiment of the present invention.

FIG. 1 is a diagram schematically showing the circuit configuration of the liquid crystal display device. The liquid crystal display device includes a liquid crystal display panel DP of an OCB mode and a display panel control circuit CNT connected to the display panel DP. The liquid crystal display panel DP has a structure in which a liquid crystal layer 3 is held between a pair of electrode substrates, namely, an array substrate 1 and a counter-substrate 2. The liquid crystal layer 3 contains a liquid crystal material in which liquid crystal molecules are aligned in a splay alignment in a voltage-non-applied state. To attain a display operation of normally white, the display panel control circuit CNT initializes the display panel DP upon supply of power by applying a relatively high transition voltage that transitions the alignment of the liquid crystal molecules from the splay alignment to a bend alignment to the liquid crystal layer 3 as a liquid crystal drive voltage from the array substrate 1 and counter-substrate 2. In the display operation of the liquid crystal display panel DP, the liquid crystal drive voltage is applied to the liquid crystal layer 3 in order to control the transmittance of the display panel DP, and further a black-display voltage is periodically applied to the liquid crystal layer 3 as the liquid crystal drive voltage in order to prevent the reverse transition from the bend alignment to the splay alignment.

The array substrate 1 includes a plurality of pixel electrodes PE which are arranged substantially in a matrix on a transparent insulating substrate such as of glass, a plurality of gate lines Y (Y0 to Ym) which are arranged along the rows of pixel electrodes PE, a plurality of source lines X (X1 to Xn) which are arranged along the columns of pixel electrodes (PE), and a plurality of switching elements W which are arranged near intersections between the gate lines Y and the source lines X, and each of which is turned on between one associated source line X and one associated pixel electrode PE when one associated gate line Y is driven. Each of the pixel switching elements W is composed of, for example, a thin-film transistor (TFT). The gate of the thin-film transistor is connected to the associated gate line Y, and the source-drain path is connected between the associated source line X and the associated pixel electrode PE.

The counter-substrate 2 includes a color filter which is disposed on the transparent insulating substrate made of, for example, glass, and a common electrode which is disposed on the color filter and opposed to the pixel electrodes PE. The pixel electrodes PE and the common electrode CE are made of, for example, a transparent electrode material such as ITO, and are covered with alignment films which are rubbed in mutually parallel directions. Each pixel electrode PE and the common electrode CE, together with a pixel region that is a part of the liquid crystal layer 3 held between the electrodes PE and CE constitute a pixel PX, and control the alignment of liquid crystal molecules in the pixel region by an electric field corresponding to a liquid crystal drive voltage, which is stored in a liquid crystal capacitance CLC obtained between the electrodes PE and CE and a storage capacitance Cs connected in parallel to the liquid crystal capacitance CLC. The liquid crystal pixels PX are arrayed in a matrix to respectively correspond to the pixel electrodes PE.

The display panel control circuit CNT includes a vertical driving circuit YD that selects the rows of liquid crystal pixels PX for video signal writing and for black insertion writing (non-video signal writing), a horizontal driving circuit XD that writes a video signal as pixel voltages Vs to the liquid crystal pixels PX of a row selected for the video signal writing, and writes a black display signal (non-video signal) as pixel voltages Vs to the liquid crystal pixels PX of a row selected for the black insertion writing, and a controller 5 serving as a control circuit that controls the operation timings of the horizontal driving circuit XD and vertical driving circuit YD to perform the video signal writing for the liquid crystal pixels PX in units of one row in one vertical scanning period and to perform the non-video signal writing for the liquid crystal pixels PX in units of at least one row after the first video signal writing, with a delay of a time shorter than the vertical scanning period. The display panel control circuit CNT further includes a reference gradation voltage generating circuit 7 that generates a predetermined number of reference gradation voltages VREF, a common voltage generating circuit 8 that generates a common voltage Vcom, and the like. The liquid crystal drive voltage is a potential difference between the potential of the pixel electrode PE set by the pixel voltage Vs and the potential of the common electrode CE set by the common voltage Vcom, and the polarity of the voltage is inverted in a frame-inversion drive scheme or a line-inversion drive scheme, for example.

The vertical driving circuit YD and horizontal driving circuit XD are composed of integrated circuit (IC) chips mounted on flexible wiring sheets arranged, for example, along peripheral edges of the array substrate 1. Further, the controller 5, the reference gradation voltage generating circuit 7 and the common voltage generating circuit 8 are disposed on a printed circuit board PCB provided as a separate member from the liquid crystal display panel DP.

Figure 2:
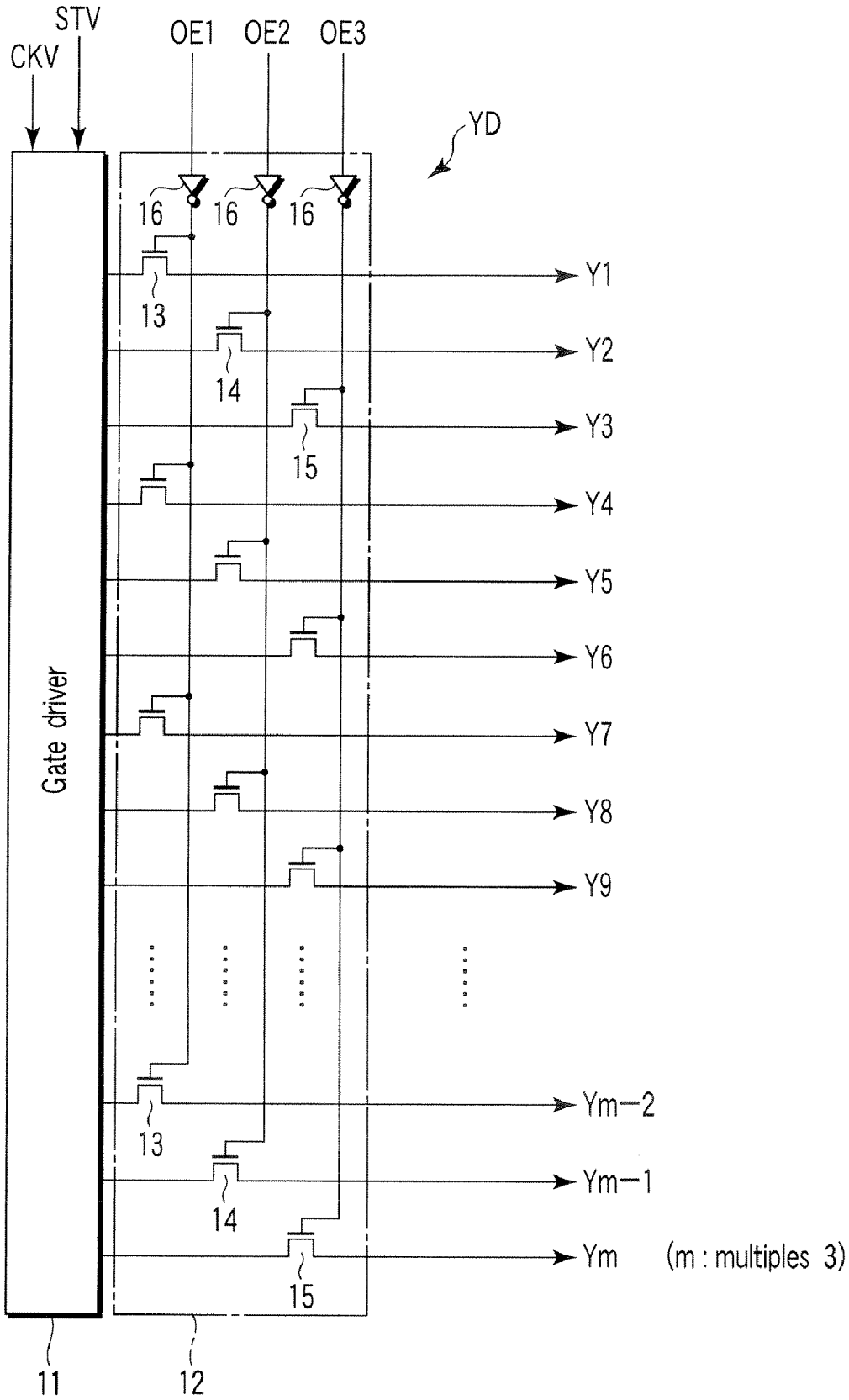
FIG. 2 is a diagram showing further details of the configuration of a vertical driving circuit shown in FIG. 1.

FIG. 2 shows the configuration of the vertical driving circuit YD in further detail. The vertical driving circuit YD includes a gate driver 11 and an output switching unit 12. The gate driver 11 receives first and second vertical start pulses STV supplied from the controller 5 every vertical scanning period, starts selection of the rows of liquid crystal pixels PX for the video signal writing and selection of the rows of liquid crystal pixels PX for the black insertion writing, in response to the first and second vertical start signals STV, and outputs drive voltages to the gate lines Y which correspond to a selected row for the video signal writing and a selected row for the black insertion writing and are changed in sync with the vertical clock signal CKV supplied from the controller 5. The output switching unit 12 receives the drive voltages output from the gate driver for the video signal writing and for the black insertion writing, and switches the drive voltages upon change in the combination of at least two enable signals to output them in a time-division manner.

More specifically, the gate driver includes a shift driver that shifts the vertical start pulse STV in sync with the vertical clock signal CKV, and thus the gate driver sequentially outputs the drive voltage to the gate lines Y1 to Ym based on the shifted position of the vertical start pulse STV. The pixel switching elements W are driven by the drive voltage from the gate line Y for the liquid crystal pixel PX of the selected row, to allow that the horizontal driving circuit XD performs a writing to the liquid crystal pixels PX of the selected row.

Here, enable signals OE1 to OE3 are supplied as a control signal from the controller 5 to the output switching unit 12. Thus, the output switching unit 12 includes an m/3 number of switching transistors 13 connected to control the drive voltages output from the gate driver 11 to the gate lines Y1, Y4, Y7, . . . , Ym-2, an m/3 number of switching transistors 14 connected to control the drive voltages output from the gate driver 11 to the gate lines Y2, Y5, Y8, . . . , Ym-1, an m/3 number of switching transistors 15 connected to control the drive voltages output from the gate driver 11 to the gate lines Y3, Y6, Y8, . . . , Ym, and three inverter circuits 16 that output inversion signal of the enable signals OE1 to OE3 to the gates of the switching transistors 13, 14 and 15.

The horizontal driving circuit XD includes a shift register that receives a horizontal start pulse STH supplied every horizontal scanning period, and shifts the horizontal start pulse STH in sync with the horizontal clock signal CKH. To the horizontal driving circuit XD, items of pixel data DATA (video signal S or black display signal B) for one row (horizontal line) are supplied in series during the horizontal scanning period. The horizontal driving circuit XD captures the items of pixel data DATA based on the shifted position of the horizontal start pulse STH, converts them into pixel voltages Vs with reference to the reference gradation voltages VREF, and outputs the pixel voltages Vs in parallel toward the source lines X1 to Xn, in response to a latch output pulse LT.

In the liquid crystal pixels PX of each row, the pixel voltages Vs of the video signal are held only for the period from the video signal writing to the black insertion writing, to perform the video signal display, and further the pixel voltages Vs of the black display signal are held only for the period from the black insertion writing to the next video signal writing, to perform the black insertion (non-video signal) display.

Figure 3:
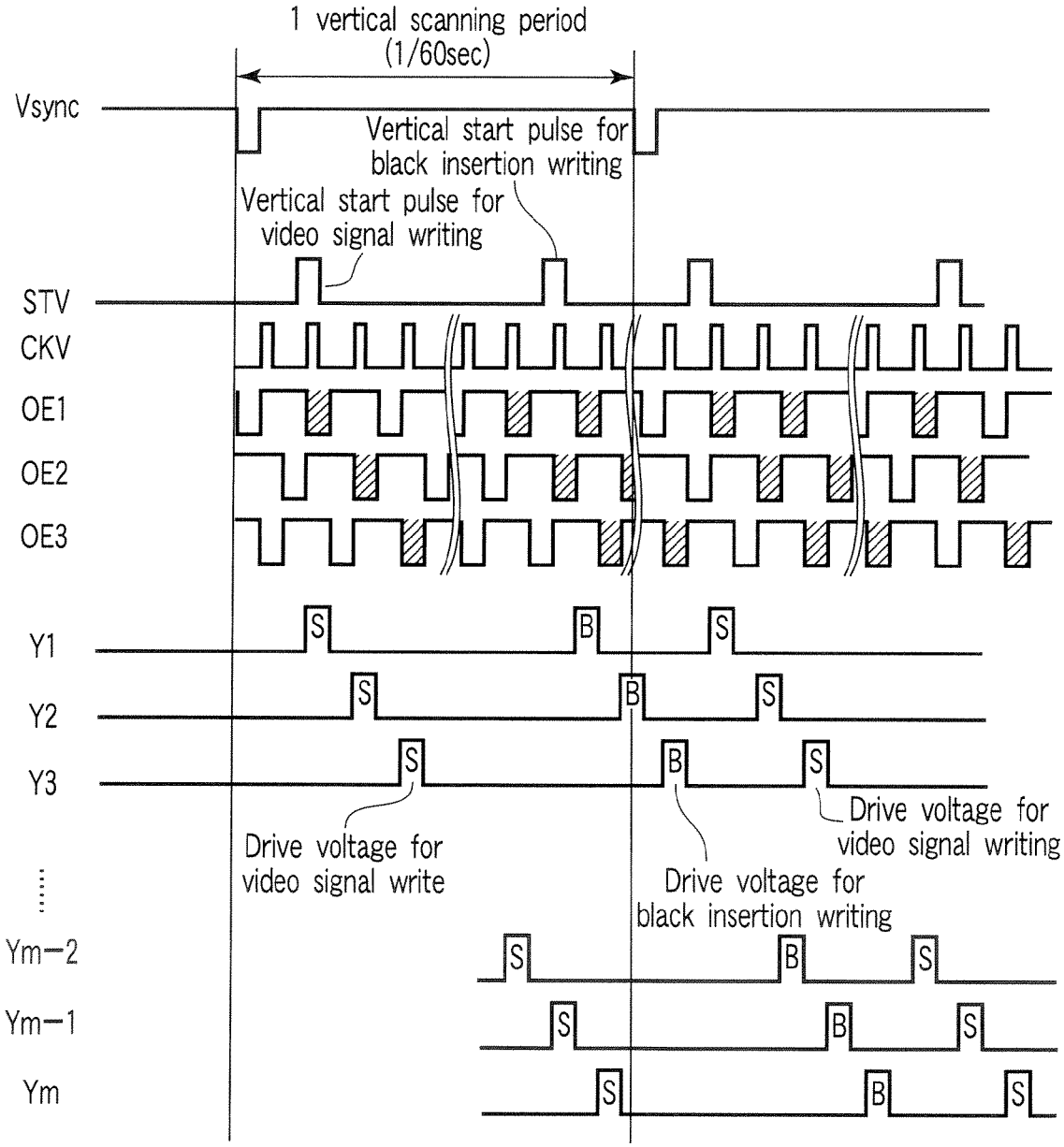
FIG. 3 is a diagram showing signal waveforms obtained in the operation of the liquid crystal display device shown in FIG. 1.

FIG. 3 shows signal waveforms obtained in the operation of the liquid crystal display device. The vertical driving circuit YD sequentially selects the liquid crystal pixels PX for the video signal writing in units of one row upon supply of the first vertical start pulse STV, and further sequentially selects the liquid crystal pixels PX for the black insertion writing in units of one row upon supply of the second vertical starting pulse STV. The vertical clock signal CKV has a clock cycle equal to one horizontal scanning period. The gate driver 11 outputs the drive voltage for each one horizontal scanning period to the gate line Y corresponding to a selected row which is changed in sync with the vertical clock signal CKV. In the selection for the video signal writing, the output switching unit 12 inhibits the output of the drive voltage to the gate line Y corresponding to a selected row in the first half of one horizontal scanning period and permits the output in the last half of the horizontal scanning period, based on the combination of the enable signals OE1 to OE3. On the other hand, in the selection for the black insertion writing, the output switching unit 12 permits the output of the drive voltage to the gate line Y corresponding to a selected row in the first half of one horizontal scanning period and inhibits the output in the last half of the horizontal scanning period, based on the combination of the enable signals OE1 to OE3. In this manner, a selection pattern for disabling an overlap between a selection period of selecting the liquid crystal pixels PX of each row for the video signal writing and a selection period of selecting the liquid crystal pixels of another row for the non-video signal writing is set.

To perform the video signal writing, the gate lines Y1 to Ym are sequentially selected for one horizontal scanning period H in one vertical scanning period, and each selected line is driven by the drive voltage output in the last half of the associated horizontal scanning period H. Each of the video signals S, S, S, . . . is converted into pixel voltages Vs in the last half of the associated horizontal scanning period and the converted voltages are output respectively to the source lines X1 to Xn in parallel. The pixel voltages Vs for the liquid crystal pixels PX of the 1st row are written while the gate lines Y1 is driven in the last half of the horizontal scanning period H. The pixel voltages Vs for the liquid crystal pixels PX of the 2nd row, 3rd row, . . . are written while the gate lines Y2, Y3, . . . are respectively driven in the same manner.

After the video signal holding period for the liquid crystal pixels PX of the first selected row expires, the gate lines Y1 to Ym are sequentially selected for one horizontal scanning period H, and each selected line is driven by the drive voltage output in the last half of the associated horizontal scanning period H. Each of the black-display signals B, B, B, . . . is converted into pixel voltages Vs in the first half of the associated horizontal scanning period and the converted voltages are output respectively to the source lines X1 to Xn in parallel. The pixel voltages Vs for the liquid crystal pixels PX of the 1st row are written while the gate lines Y1 is driven in the first half of the horizontal scanning period H. The pixel voltages Vs for the liquid crystal pixels PX of the 2nd row, 3rd row, . . . are written while the gate lines Y2, Y3, . . . are respectively driven in the same manner.

Figure 4:
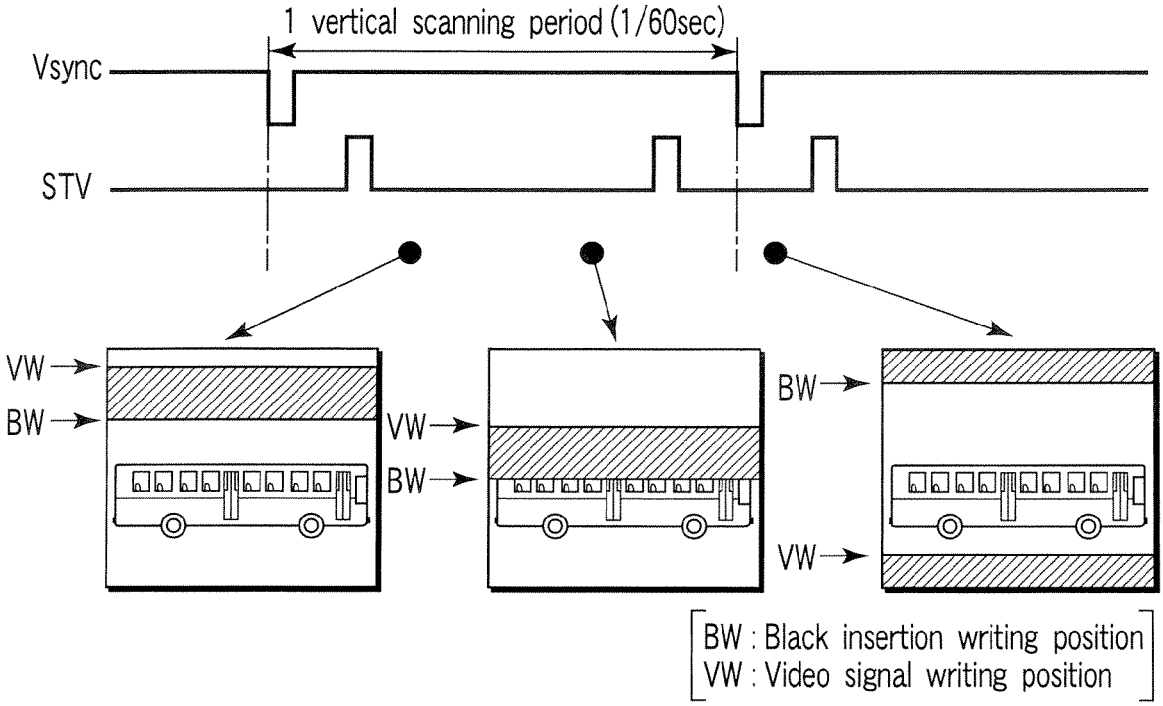
FIG. 4 is a diagram showing images displayed by the operation of the liquid crystal display device shown in FIG. 1.

FIG. 4 shows images displayed by the operation of the liquid crystal display device. It can be understood from the comparison between the images displayed at timings indicated by three black circles shown in FIG. 4 that there is a certain time offset provided between a video signal writing position and a black insertion writing position. The black display area does not change its entire area but it moves from the upper end of the display screen to the lower end thereof.

In this embodiment, an overlap between a selection period of selecting the liquid crystal pixels PX of each row for the video signal writing and a selection period of selecting the liquid crystal pixels of another row for the non-video signal writing is disabled by the output switching unit 12. Further, the time from the first video signal writing to the non-video signal writing is adjustable by the time interval of the vertical start pulses STV. Therefore, the black display area that occupies the entire display area can be set to a desired ratio, and thus the average luminance can be stabilized. In other words, the black display area does not change along with time, and therefore flicker that is caused by a periodical operation of the video signal display and black insertion display (non-video signal display) can be suppressed.

Further, the vertical driving circuit YD has a simple structure in which the output switching unit 12 is added to the gate driver 11, which can be made of general-purpose gate drivers IC such as those employed in the conventional black insertion driving method. With this structure, the production cost can be reduced as compared to the case where the gate driver IC that can disable an overlap between a selection period of selecting the liquid crystal pixels PX of each row for the video signal writing and a selection period of selecting the liquid crystal pixels of another row for the non-video signal writing, is newly designed.

It should be noted that the present invention is not limited to the above-described embodiment, but various modifications may be made without departing from the spirit or scope of the present invention.

Figure 5:
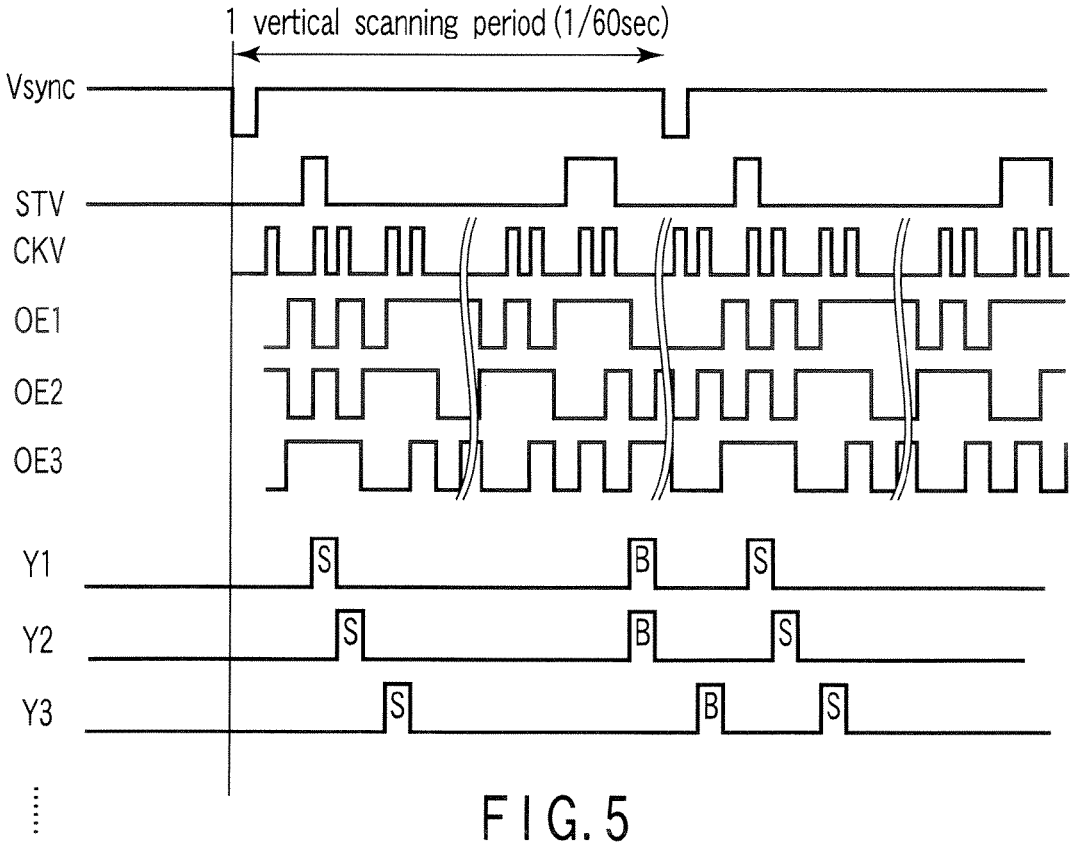
FIG. 5 is a diagram showing signal waveforms obtained in a modification in which the waveforms of a vertical start pulse and vertical clock signal supplied from a controller to the vertical driving circuit shown in FIG. 2 are modified.
Figure 6:
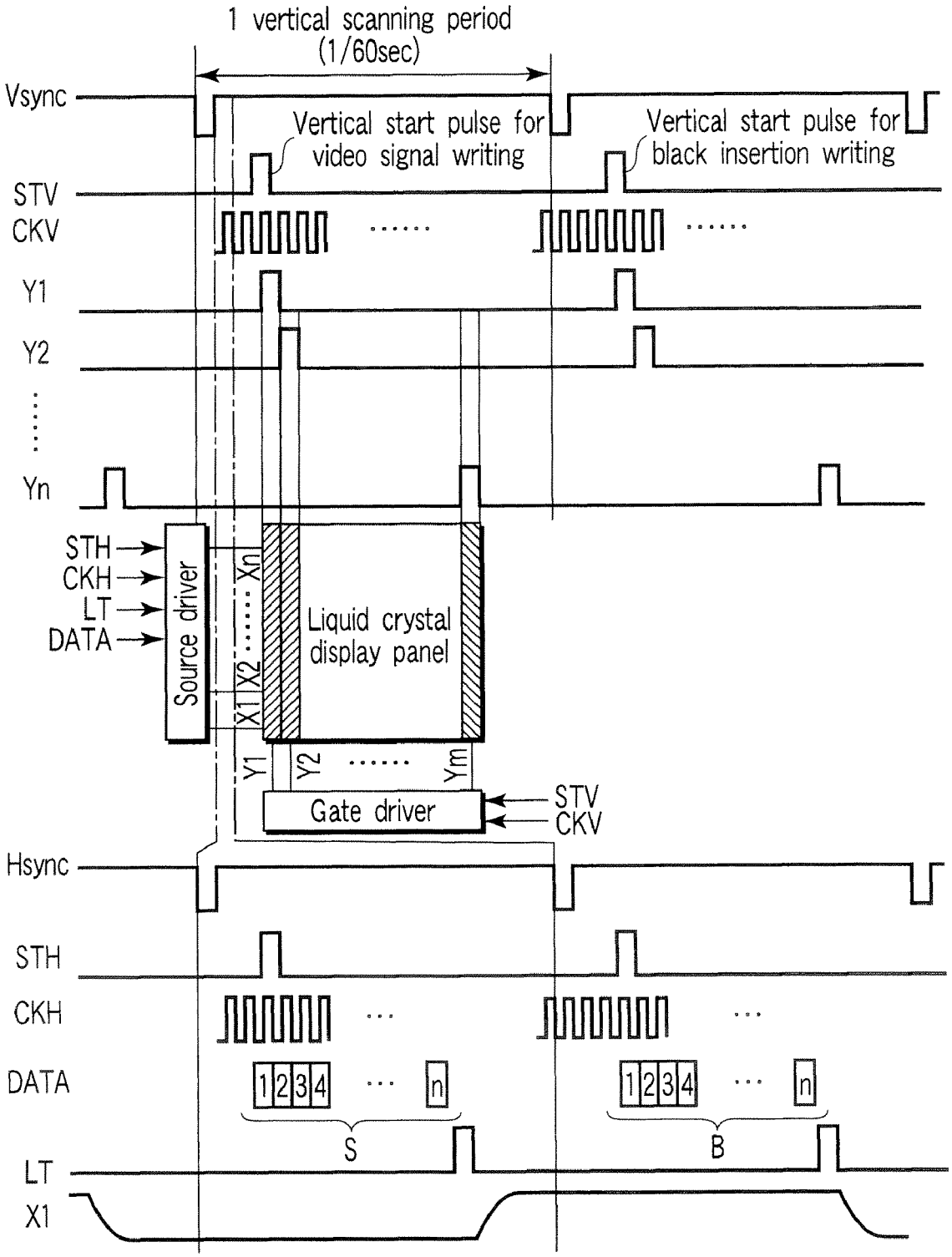
FIG. 6 (PRIOR ART)
FIG. 6 is an explanatory diagram that illustrates the conventional black insertion driving method.

FIG. 5 shows signal waveforms obtained in a modification in which the waveforms of a vertical start pulse and vertical clock signal supplied from a controller 5 to the vertical driving circuit YD are modified.

In this modification, the vertical driving circuit YD sequentially selects the liquid crystal pixels PX for the video signal writing in units of one row upon supply of the first vertical start pulse STV, and further sequentially selects the liquid crystal pixels PX for the black insertion writing in units of two rows upon supply of the second vertical starting pulse STV. The first vertical start pulse STV is set to have a pulse width for one clock cycle of the vertical clock signal CKV, whereas the second vertical start pulse STV is set to have a pulse width for two clock cycles. Further, the vertical clock signal CKV has a clock cycle equal to one horizontal scanning period, and it is thinned out at a rate of 1 pulse per 3 clock cycles. Accordingly, the combination of the enable signals OE1 to OE3 is also changed as shown in FIG. 5. In this manner, a selection pattern for disabling an overlap between a selection period of selecting the liquid crystal pixels of each row for the video signal writing and a selection period of selecting the liquid crystal pixels of another row for the non-video signal writing, is set.

In the above-described embodiment and modification, the vertical start pulse STV and vertical clock signal CKV are used together with three enable signals OE1 to OE3 supplied to the input switching unit 12, but these enable signals may be replaced with at least two enable signals.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A liquid crystal display device comprising:

a plurality of liquid crystal pixels arrayed substantially in a matrix;

a vertical driving circuit that selects rows of the liquid crystal pixels for video signal writing and for non-video signal writing;

a horizontal driving circuit that writes a video signal in the liquid crystal pixels of a row selected for the video signal writing and a non-video signal in the liquid crystal pixels of a row selected for the non-video signal writing; and a control circuit that generates a control signal to prevent any overlap between the video signal writing of one row and the non-video signal writing of any other row, and controls operation timings of the horizontal driving circuit and the vertical driving circuit to perform the video signal writing for each row of the liquid crystal pixels in units of one row in one vertical scanning period and to perform the non-video signal writing for the liquid crystal pixels in units of at least one row after the first video signal writing, with a delay of a time shorter than the vertical scanning period, wherein the vertical driving circuit is configured to set a selection pattern for disabling any overlap between a selection period of selecting the liquid crystal pixels of each row for the video signal writing and a selection period of selecting the liquid crystal pixels of any other row for the non-video signal writing, based on the control signal from the control circuit, the liquid crystal pixels constitute a display panel together with a plurality of gate lines which are arranged along the rows of liquid crystal pixels and a plurality of pixel switching elements which are arranged near the liquid crystal pixels, and are turned on to allow the horizontal driving circuit to perform writing to the liquid crystal pixels of a selected row when the gate line corresponding to the liquid crystal pixels of the selected row is driven, and the vertical driving circuit includes a gate driver that receives first and second vertical start pulses supplied from the control circuit every vertical scanning period, starts selection of the rows of liquid crystal pixels for the video signal writing and selection of the rows of liquid crystal pixels for a black insertion writing in response to the first and second vertical start pulses, and outputs drive voltages to the gate lines which correspond to a selected row for the video signal writing and a selected row for the black insertion writing and are changed in sync with a vertical clock signal supplied from the control circuit, and an output switching unit that receives the drive voltages output from the gate driver for the video signal writing and for the black insertion writing, and switches the drive voltages upon changes in a combination of at least two enable signals, to output them in a time-division manner.

2. The liquid crystal display device according to claim 1, wherein the control circuit is further configured to periodically thin out a pulse of the vertical clock signal when the liquid crystal pixels are selected in units of two or more rows for the non-video signal writing by the control of the second vertical start pulse.

3. The liquid crystal display device according to claim 1, wherein the control signal from the control circuit includes at least two enable signals.

* * * * *